US009221068B2

(12) United States Patent
Jessup et al.

(10) Patent No.: US 9,221,068 B2
(45) Date of Patent: Dec. 29, 2015

(54) APPARATUS FOR NON-CONTACT CLEANING A PAINT SPRAY TIP

(71) Applicants: Philip Jessup, Ennismore (CA); Eleanor Jessup, Ennismore (CA)

(72) Inventors: Philip Jessup, Ennismore (CA); Eleanor Jessup, Ennismore (CA)

( * ) Notice: Subject to any disclaimer, the term of this patent is extended or adjusted under 35 U.S.C. 154(b) by 112 days.

(21) Appl. No.: 14/049,347

(22) Filed: Oct. 9, 2013

(65) Prior Publication Data

US 2015/0097051 A1 Apr. 9, 2015

(51) Int. Cl.

| | |
|---|---|
| ***B05B 15/02*** | (2006.01) |
| ***B08B 3/02*** | (2006.01) |
| ***B08B 3/08*** | (2006.01) |
| ***B08B 3/10*** | (2006.01) |
| ***B05B 7/02*** | (2006.01) |
| ***B05B 7/16*** | (2006.01) |

(52) U.S. Cl.

CPC ..... *B05B 15/0258* (2013.01); *B05B 7/02* (2013.01); *B05B 7/1673* (2013.01); *B08B 3/02* (2013.01)

(58) Field of Classification Search

CPC .... B05B 7/02; B05B 15/025; B05B 15/0258; B08B 3/006; B08B 3/02; B08B 3/08; B08B 3/10; B44D 3/006

See application file for complete search history.

(56) References Cited

U.S. PATENT DOCUMENTS

| | | | | |
|---|---|---|---|---|
| 2,682,273 | A * | 6/1954 | Roach | 134/102.1 |
| 4,025,363 | A * | 5/1977 | De Santis | 134/102.2 |
| 4,785,836 | A * | 11/1988 | Yamamoto | 134/56 R |
| 4,827,955 | A * | 5/1989 | Stern | 134/99.1 |
| 4,977,911 | A * | 12/1990 | Vetter et al. | 134/34 |
| 5,174,317 | A * | 12/1992 | Robb et al. | 134/166 C |
| 5,183,066 | A * | 2/1993 | Hethcoat | 134/54 |
| 6,355,114 | B1 * | 3/2002 | White et al. | 134/34 |
| 7,467,634 | B2 | 12/2008 | Jessup et al. | |

* cited by examiner

*Primary Examiner* — Darren W Gorman
(74) *Attorney, Agent, or Firm* — Dinsmore & Shohl LLP

(57) ABSTRACT

An apparatus for non-contact cleaning a paint spray tip of a spray gun. The apparatus includes a housing with a top and an opening formed in the top to receive the spray tip. At least one drier nozzle is fluidly connected to a source of compressed air so that discharge from the nozzle impinges upon and dries the spray tip. Similarly, at least one solvent nozzle is also attached to the housing around the opening and discharges solvent on the spray tip when positioned in the housing opening. One or more down flow nozzles are also mounted to the housing to create a downdraft through the housing opening to facilitate cleaning and drying of the spray gun spray tip. A heated fluid also flows through the housing in close proximity to the fluid passageways for the drier nozzle and solvent nozzle in order to heat both the drier nozzle air flow and solvent flow to facilitate cleaning of the spray tip.

13 Claims, 4 Drawing Sheets

APPARATUS FOR NON-CONTACT CLEANING A PAINT SPRAY TIP

BACKGROUND OF THE INVENTION

I. Field of the Invention

The present invention relates generally to cleaning devices and, more particularly, to a cleaning device for cleaning the paint spray tip of a spray gun.

II. Description of Related Art

Industrial spray painting equipment is widely used throughout the industry in many different applications. For example, robots manipulate paint spray guns in the automotive industry in order to paint automotive vehicles as well as components for those vehicles.

In many applications it is desirable, indeed oftentimes required, to clean the spray tip of the paint sprayer between spraying operations. Otherwise, accumulated paint on the spray tip for the paint sprayers can result in paint drip, uneven paint spray, as well as other aesthetic defects. When this happens, it is oftentimes necessary to completely remove the paint sprayed on the article and then repaint the article. This, however, is costly and time consuming.

There have, however, been previously known devices for cleaning the spray tips of paint sprayers of the type manipulated by robots. For example, U.S. Pat. No. 7,467,634 to Jessup, entitled "No Contact Spray Apparatus Cleaning Device", discloses a non-contact device for cleaning the spray tip of a robotic paint sprayer. In this previously known device, the paint spray tip is inserted through an opening in the top of a housing and sprayed with a solvent for the paint. After spraying, drier air is discharged on the paint spray tip in order to dry the paint spray tip. In addition, downdraft nozzles contained within the housing create a downdraft or a partial vacuum within the housing to draw air flow down through the opening in the top of the housing and across the paint spray tip.

These previously known devices for non-contact cleaning the paint spray tip of a spray gun have proven entirely adequate when used with solvent-based paints. For such solvent-based paints, the drier air flow has proven more than satisfactory for completely drying the paint spray tip after cleaning by the solvent.

However, due to government regulations as well as other concerns, many industries have shifted from solvent-based paints to water-based paints. With these previously known devices for non-contact cleaning of the paint spray tip of the spray gun, the spray tips are oftentimes not adequately dried upon removal from the device. While adequate drying of the paint spray tip may be achieved by increasing the cycle time for the non-contact cleaning device, such increased cycle time unacceptably increases the cycle time of the overall painting operation. This, in turn, increases the overall cost of the painting operation.

SUMMARY OF THE PRESENT INVENTION

The present invention provides an apparatus for non-contact cleaning of a paint spray tip of a spray gun which overcomes the above-mentioned disadvantages of the previously known devices.

In brief, the apparatus of the present invention comprises a housing having a top and an opening in the top dimensioned to receive the spray tip so that the spray tip does not contact the housing. Typically, the spray tip is mounted on a spray gun manipulated by a robot.

At least one drier nozzle is attached to the housing so that a discharge from the drier nozzle impinges against the spray tip as the spray tip is withdrawn from the housing. Preferably, a plurality of drier nozzles are placed at circumferentially spaced positions around the housing opening so that air from the drier nozzles impinges against all sides of the spray tip.

At least one, and preferably several circumferentially spaced solvent nozzles are also mounted in the housing and are oriented to discharge solvent on the spray tip once the spray tip is positioned in the housing opening. The solvent nozzle is connected to a solvent passageway formed through the housing and then to a source of pressurized solvent. The actual solvent will, of course, depend upon the type of paint that is sprayed by the spray gun.

The housing also includes a heater fluid passageway in close proximity to the solvent passageway as well as the drier air passageway. Preferably, all passageways extend through one or more heat sinks within the housing. Thus, the heat from the heated water flowing through the housing simultaneously heats both the drier air as well as the solvent. This, in turn, facilitates faster and complete drying of the spray tip following a cleaning operation, particularly in the case where the paint is a water-based paint.

At least one down flow nozzle is positioned beneath the housing opening and is oriented in a direction away from the housing opening. The flow of compressed air through the down flow nozzles effectively creates a lowered pressure region below the housing opening thus drawing air from the drier nozzles downwardly through the housing and across the spray tip.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
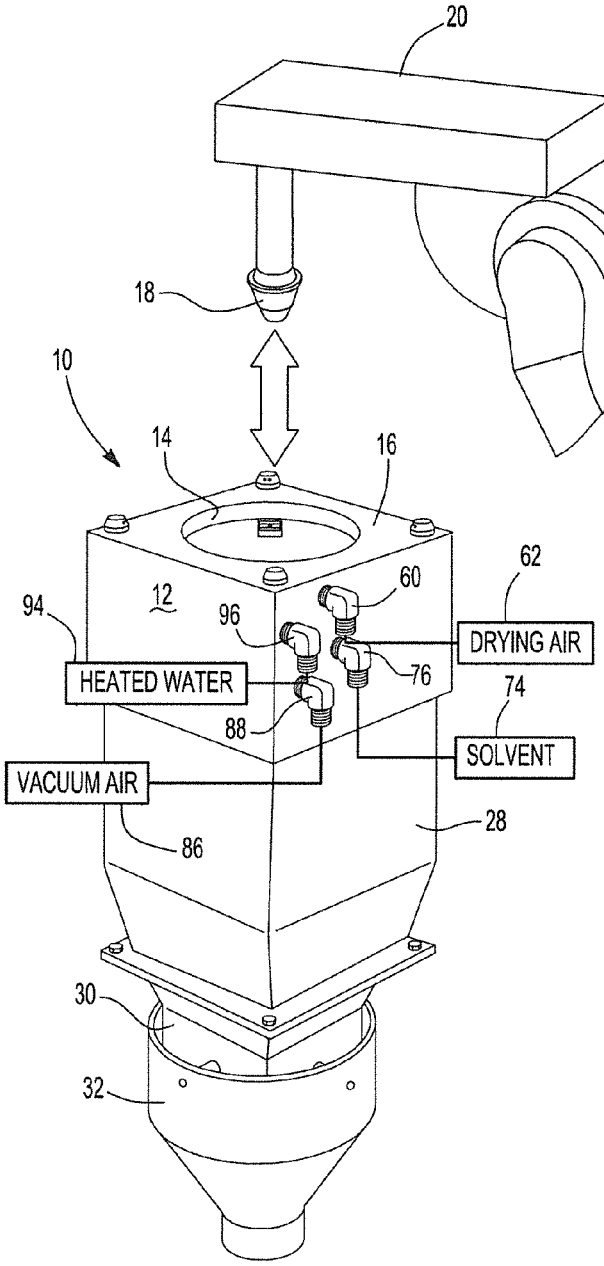
FIG. 1 is a fragmentary elevational view illustrating a preferred embodiment of the present invention.
Figure 2:
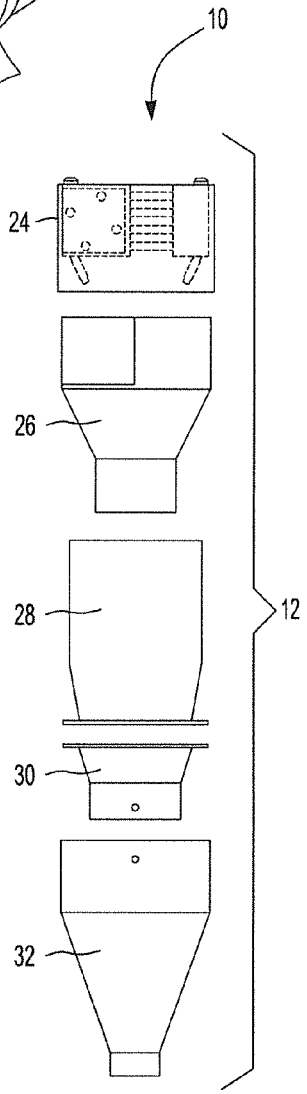
FIG. 2 is a side exploded view illustrating the preferred embodiment of the present invention.

With reference first to FIGS. 1 and 2, a preferred embodiment of a non-contact cleaning apparatus 10 according to the present invention is shown. The apparatus 10 includes a housing 12 which is constructed from any appropriate material, such as sheet metal. The housing 12 includes a generally circular opening 14 in its top 16. This opening 14, furthermore, is dimensioned to receive a spray tip 18 of a paint spray gun 20, typically manipulated by a robot 22 (only partially illustrated).

Still referring to FIGS. 1 and 2, the housing 12 preferably includes a plurality of housing sections, including a top section 24 as well as lower housing sections 26, 28, 30, and 32.

These housing sections 24-32 are secured together in any appropriate fashion, such as by bolts. In addition, the housing sections 24-32 all include a vertically open passageway so that the solvent may be collected and recycled or disposed of. The air flows through the opening 14 in the top housing section 24, through the housing sections 32, and out through a baffle between housing sections 30 and 32.

Figure 5:
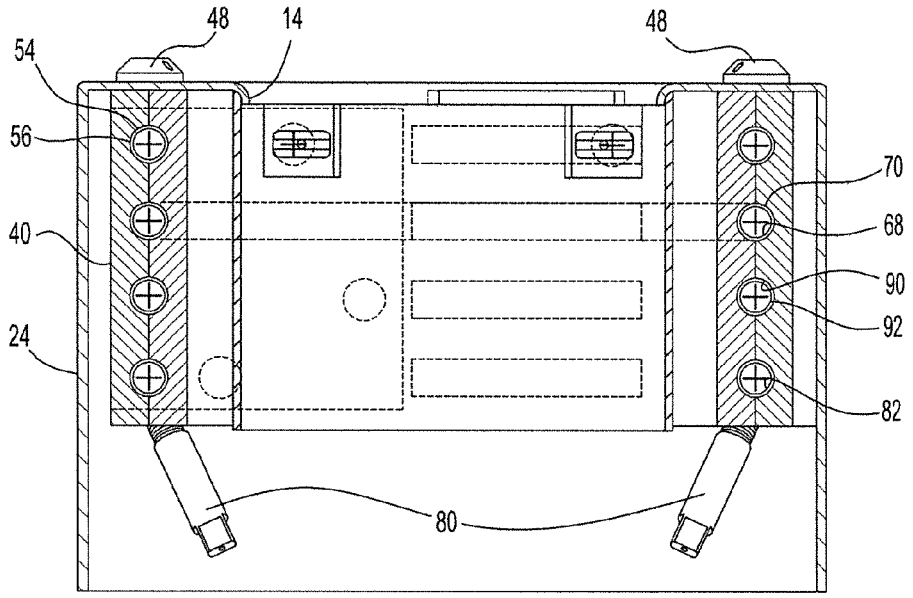
FIG. 5 is a view taken substantially along line 5-5 in FIG. 3.
Figure 6:
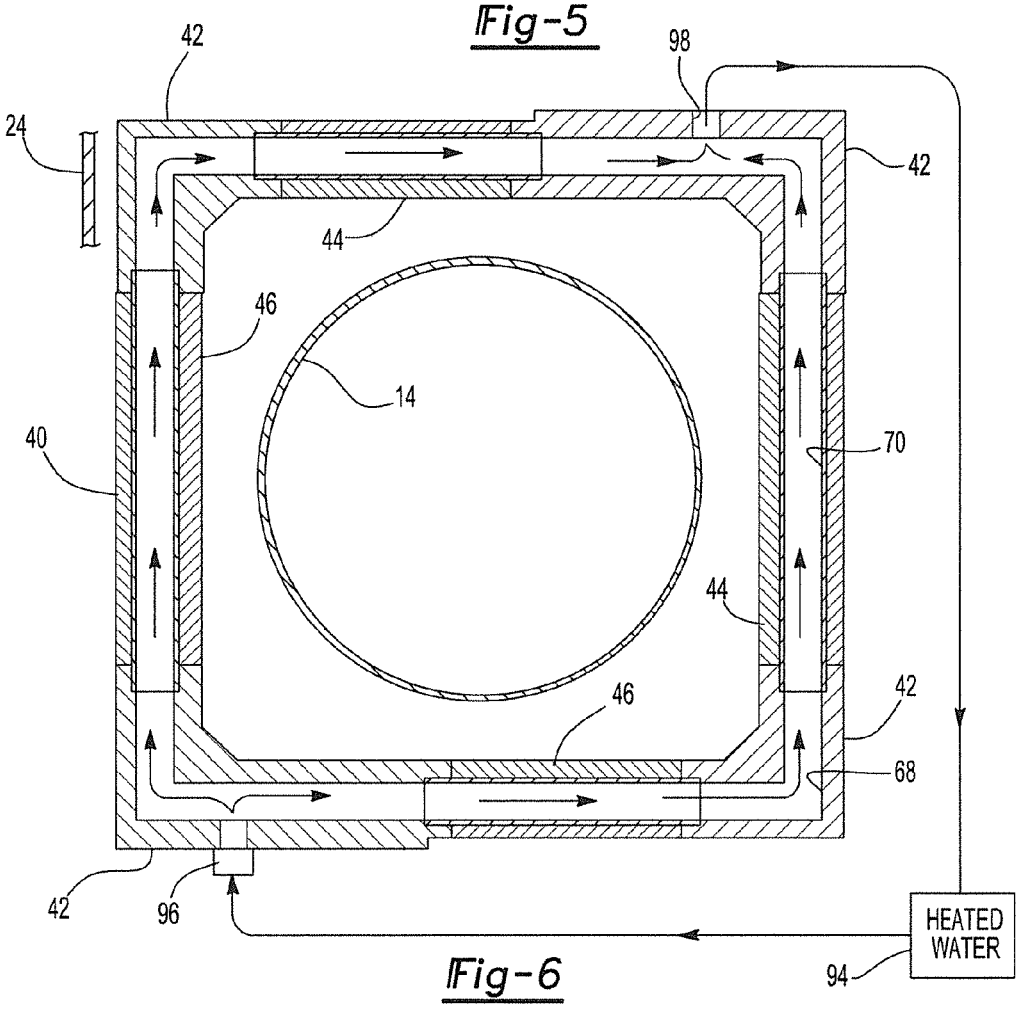
FIG. 6 is a sectional view taken substantially along line 6-6 in FIGS. 4.
Figure 7:
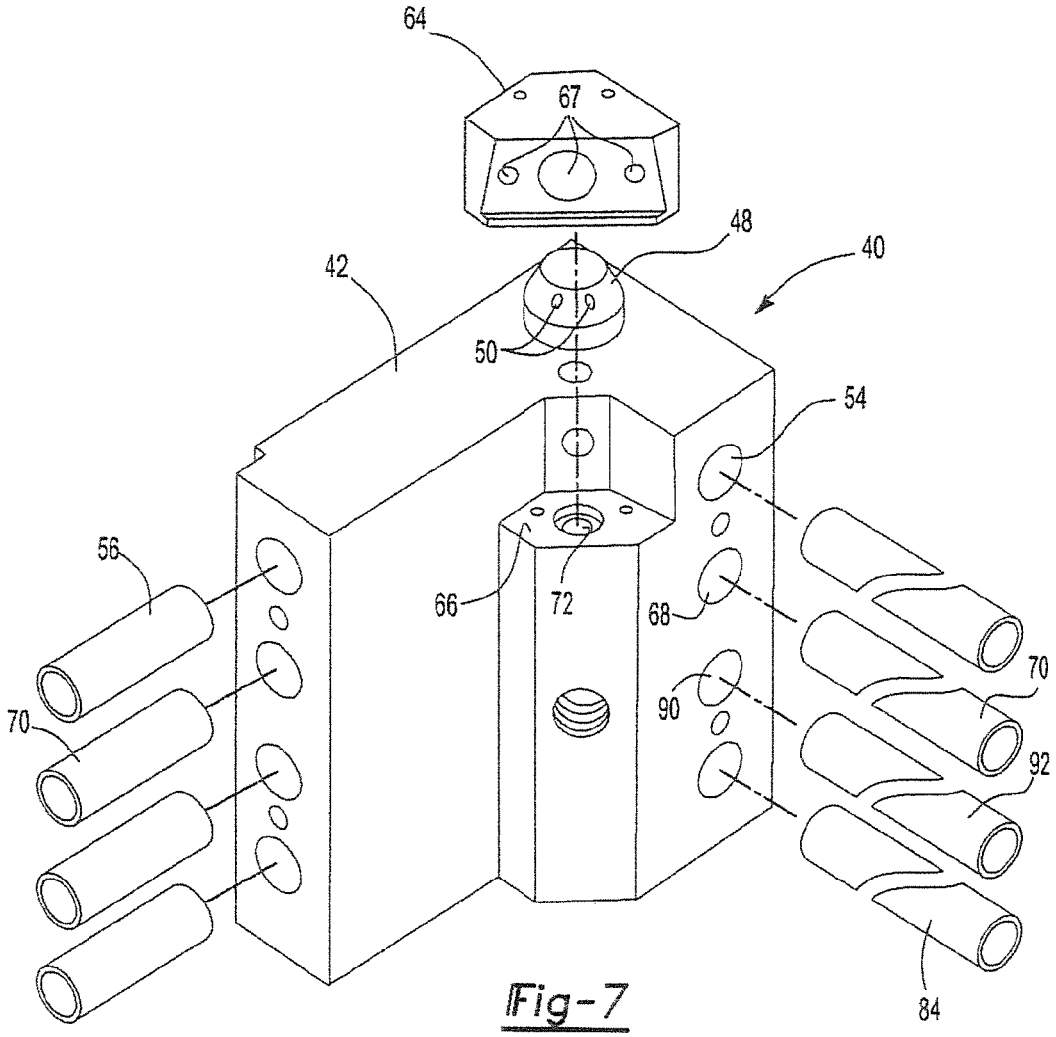
FIG. 7 is a fragmentary elevational and exploded view of a portion of the preferred embodiment of the present invention.

With reference now to FIGS. 5-7, a heat sink 40 is contained within the housing upper section 24 so that the heat sink 40 extends entirely around the opening 14. Although the heat sink. 40 is illustrated in the drawing as substantially rectangular in cross-sectional shape (see FIG. 5), the heat sink may be of any appropriate shape surrounding the opening 14 without deviation from the scope or spirit of the invention. Furthermore, the heat sink 40 is constructed from a material, such as metal, with high thermal conductivity. In the preferred embodiment, the heat sink is constructed from aluminum.

As best shown in FIGS. 6 and 7, the heat sink 40 preferably includes a corner section 42 at each of the four corners of the housing upper section 24. Linear sections 44 and 46 of the heat sink 40 (FIG. 6) extend between and connect the corner sections 42 of the heat sink 40 together.

Figure 4:
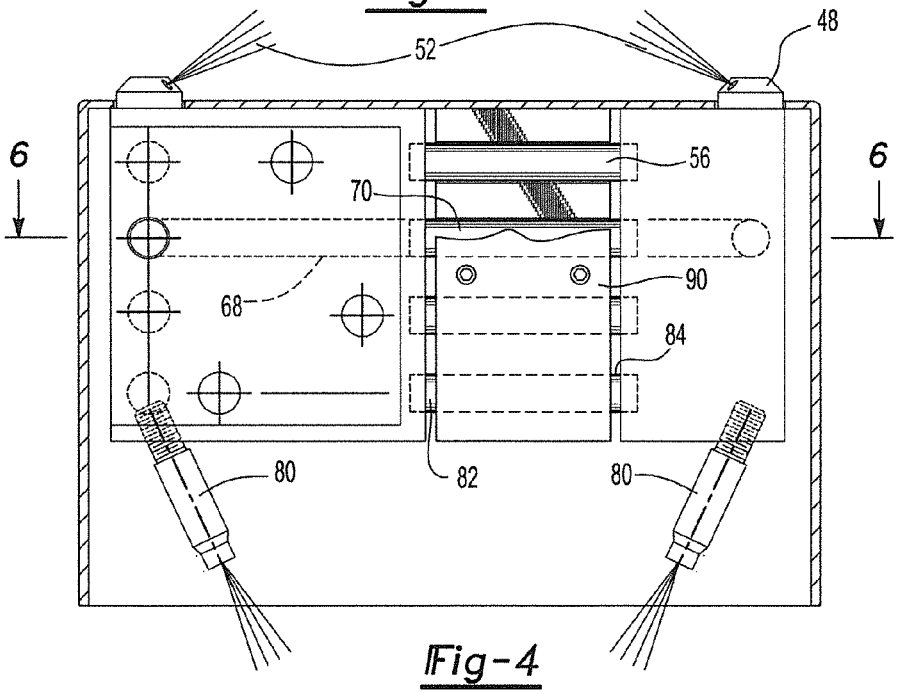
FIG. 4 is a view taken substantially along line 4-4 in FIG. 3 and with parts removed for clarity.

As best shown in FIGS. 4 and 7, an air drier nozzle 48 is attached to at least one, and preferably all four of the corner sections 42 of the heat sink. The air drier nozzles 48 include openings 50 (FIG. 7) which, when connected to a source 62 of pressurized air, discharge air toward the center and above of the housing opening 14 as shown at 52. Consequently, as a spray tip 18 (FIG. 1) is withdrawn from the housing opening 14 following a cleaning operation, the flow of pressurized air through the nozzles 48 will impinge upon and dry the spray tip 18.

Figure 3:
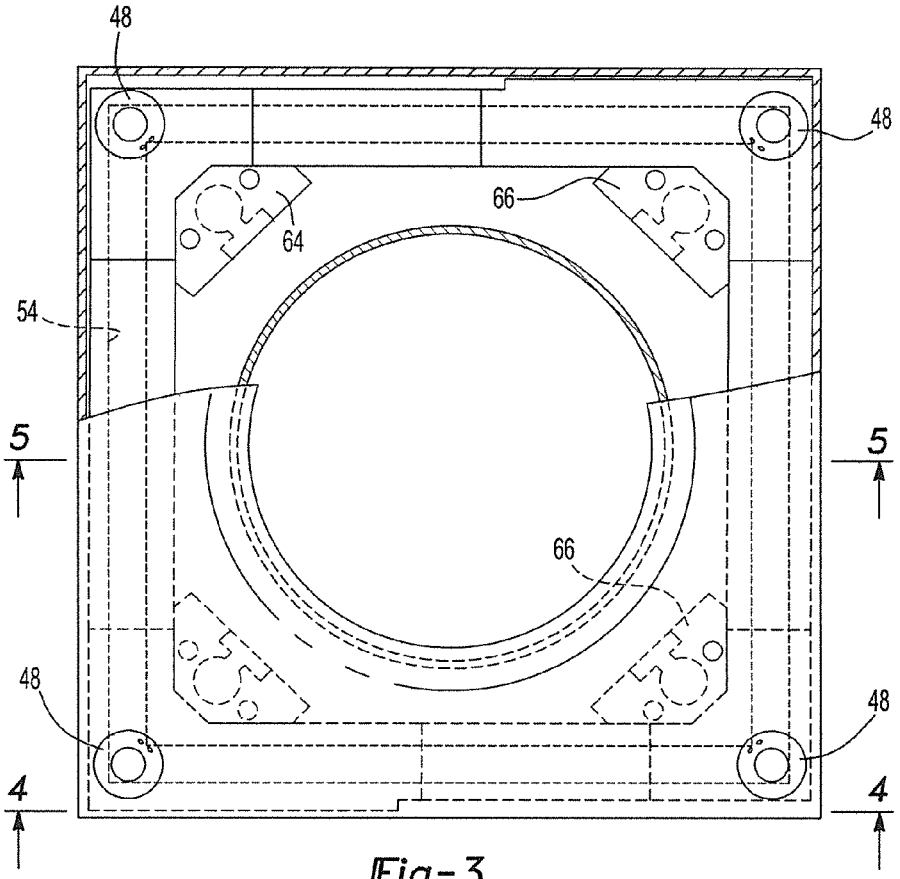
FIG. 3 is a top plan view of the present invention.

As best shown in FIGS. 3 and 5, a drier air passageway 54 is formed through the heat sink 40 entirely around the heat sink 40. This drier air passageway 54 may be formed, for example, by tubes 56 (FIGS. 5 and 7) which extend through bores in the heat sink 40. These tubes 56, furthermore, are also constructed of a heat conductive material, such as metal, so that heat may flow by conduction from the heat sink 40 and to the drier air supply tubes 56. Furthermore, a drier air inlet 60 (FIG. 1) is open exteriorly of the housing 12 and fluidly connects the drier air passageway 54 to the source 62 of pressurized air.

With reference now to FIGS. 3, 5, and 7, at least one, and preferably a plurality of solvent nozzles 64 are mounted within the housing 12 around the housing opening 14. Preferably, each solvent nozzle 64 is mounted to a flat 66 formed in each corner section 42 of the heat sink 40. Each solvent nozzle 64 includes one or more discharge ports 67 which are oriented so that, when connected to a source 74 (FIG. 1) of pressurized solvent, sprays the solvent towards the center of the housing opening and thus against the nozzle tip 18 when positioned within the nozzle opening.

A solvent passageway 90 is formed within the heat sink 40. Furthermore, a tube 92 constructed of a material having high thermal conductivity is preferably positioned within the heat sink 40 to fluidly connect the solvent passageway 90 to the solvent nozzles 64 through an opening 72 in each heat sink corner ledge 66.

With reference now to FIG. 1, the solvent passageway 90 is fluidly connected to the source 74 of solvent through a fluid fitting 76 open exteriorly of the housing 12. The actual type of solvent will, of course, vary depending upon the type of paint. For example, for water-based paints, the solvent typically comprises water.

Referring now to FIG. 4, at least one, and preferably four circumferentially spaced down flow nozzles 80 are mounted to the housing 12 and positioned around and below the housing opening 14. These down flow nozzles 80, as best shown in FIG. 4, are directed downwardly and away from the housing opening 14. A down flow air passageway 82 extends through the heat sink 40 and is fluidly connected to each down flow nozzle 80. Tubes 84 having high thermal conductivity extend through the heat sink 40 to form the down flow fluid passageway which interconnects the down flow nozzles 80 together. This fluid passageway, furthermore, is connected to a source 86 (FIG. 1) of pressurized air through a fluid connector 88 accessible exteriorly of the housing 12.

In operation, upon connection of the down flow nozzles 80 to the source 82 of pressurized air, pressurized air is expelled from the nozzles 80 downwardly and below the opening 14 in the housing 12. This, in turn, creates a partial vacuum below the housing opening 14 which serves to induct air flow from the air drier nozzles 48 down through the housing opening 14 and across the spray tip 18 when positioned within the housing opening 14.

With reference now to FIGS. 5, 6, and 7, a heated fluid passageway 68 is formed through the heat sink 40 and this passageway may include one or more tubes 70 constructed of a high thermally conductive material, such as metal. The heated fluid passageway 68 is then fluidly coupled to a source 94 (FIG. 1) of heated fluid, preferably water, through a fluid connector 96. Consequently, as best shown in FIG. 6, heated fluid flows through the fluid coupling 96 and into the passageway 68. The heated fluid then flows around the heat sink 40 and out through an outlet 98. Since the heated fluid which flows through the heated fluid passageway 68 is uncontaminated, the outlet 98 is preferably connected back to the source 94 of heated fluid for subsequent recirculation through the heated fluid passageway 68.

The heated fluid passageway 68 is in close proximity to both the drier air passageway 54 as well as the solvent passageway 90. Consequently, since the heated fluid passageway 68 is thermally coupled to both the drier air passageway 54 and the solvent passageway 90 by the heat sink 40, the hot fluid flow through the heated fluid passageway 68 effectively heats both the drier air in drier air passageway 54 as well as the solvent in solvent passageway 90 prior to their respective discharge against the spray tip.

In operation, during a cleaning operation a spray tip 18, following a paint spraying operation, is inserted through the housing opening 14 and into the interior of the housing. Upon insertion, spray from the solvent nozzles 64 impinges upon and washes the paint from the spray tip. Simultaneously, air spray from the air drier nozzles 48 is inducted by the partial vacuum created by the downdraft nozzles 80 so that the air flows downwardly and across spray tip 18 thus drying the spray tip 18. Furthermore, as the spray tip 18 is withdrawn from the housing opening 14, the continued air flow from the air drier nozzles 48 completely dries the spray tip 18 in the desired fashion.

A primary advantage of the present invention is that the flow of the heated water through the heater fluid passageway heats both the drier air as well as the solvent. This, in turn, speeds the drying of the solvent from the spray tip 18 to a short time period in preparation for the next spraying operation. The short time period for cleaning and drying the spray tip 18 shortens, and thus enhances, the overall cycle time of the cleaning apparatus 10 of the present invention.

From the foregoing, it can be seen that the present invention provides an effective non-contact cleaning apparatus for a paint spray tip of a spray gun. Having described my invention, however, many modifications thereto will become apparent to those skilled in the art to which it pertains without deviation from the spirit of the invention as defined by the scope of the appended claims.

I claim:

1. A non-contact apparatus for cleaning a paint spray tip of a spray gun comprising:

a housing having a top and an opening in said top dimensioned to receive the spray tip such that the spray tip does not contact said housing, at least one drier nozzle attached to said housing so that a discharge from said at least one drier nozzle impinges the spray tip, said at least one drier nozzle fluidly connected through an air supply passageway to a source of pressurized air, at least one solvent nozzle attached to said housing and oriented to discharge solvent on the spray tip when positioned in said housing opening, said solvent nozzle fluidly connected through a solvent passageway to a source of solvent, at least one down flow nozzle adapted for connection with a source of pressurized air, said at least one down flow nozzle positioned in said housing at a position spaced from said top of said housing and oriented to discharge air in a direction away from said housing opening, said housing having a heater fluid passageway in close proximity to said solvent passageway and said air supply passageway, said heater fluid passageway fluidly connected to a source of heated fluid.

2. The apparatus as defined in claim 1 wherein said heated fluid comprises water.

3. The apparatus as defined in claim 1 wherein said solvent passageway and said heater fluid passageway extend through a housing portion constructed of a material with high thermal conductivity.

4. The apparatus as defined in claim 3 wherein said air supply passageway extends through said housing portion.

5. The apparatus as defined in claim 3 wherein said material with high thermal conductivity comprises metal.

6. The apparatus as defined in claim 5 wherein said metal comprises aluminum.

7. The apparatus as defined in claim 1 wherein said heater fluid passageway extends substantially entirely around said housing opening.

8. The apparatus as defined in claim 1 wherein said at least one solvent nozzle comprises a plurality of solvent nozzles spaced around said housing opening.

9. The apparatus as defined in claim 8 wherein said plurality of solvent nozzles comprises four solvent nozzles.

10. The apparatus as defined in claim 1 and comprising a heat sink disposed around said opening, said heater fluid passageway extending through said heat sink.

11. The apparatus as defined in claim 10 wherein said solvent passageway extends through said heat sink.

12. The apparatus as defined in claim 10 wherein said air supply passageway extends through said heat sink.

13. The apparatus as defined in claim 1 wherein said at least one down flow nozzle comprises a plurality of spaced apart down flow nozzles.

* * * * *